US008167331B2

(12) United States Patent
Wøllo et al.

(10) Patent No.: US 8,167,331 B2
(45) Date of Patent: May 1, 2012

(54) SPRING CARTRIDGE FOR SKI BINDING

(75) Inventors: Even Wøllo, Nærsnes (NO); Aksel Pettersen, Drøbak (NO); Thomas Holm, Oslo (NO); Øyvar Svendsen, Oslo (NO); Bernt-Otto Hauglin, Røken (NO)

(73) Assignee: Rottefella AS, Klokkarstua (NO)

( * ) Notice: Subject to any disclaimer, the term of this patent is extended or adjusted under 35 U.S.C. 154(b) by 366 days.

(21) Appl. No.: 12/430,842

(22) Filed: Apr. 27, 2009

(65) Prior Publication Data

US 2009/0295126 A1 Dec. 3, 2009

(30) Foreign Application Priority Data

Apr. 25, 2008 (EP) ..... 08155169

(51) Int. Cl.
*A63C 9/06* (2006.01)

(52) U.S. Cl. ..... 280/621; 280/619; 280/622

(58) Field of Classification Search ..... 280/615, 280/619, 621, 622
See application file for complete search history.

(56) References Cited

U.S. PATENT DOCUMENTS

| | | | | |
|---|---|---|---|---|
| 1,964,103 A | | 6/1934 | Attenhoffer | |
| 2,094,667 A | | 10/1937 | Parish | |
| 3,137,014 A | | 6/1964 | Meucci | |
| 3,282,597 A | * | 11/1966 | Berchtold et al. | 280/622 |
| 3,305,242 A | * | 2/1967 | Marker | 280/622 |
| 3,403,920 A | * | 10/1968 | Adam | 280/622 |
| 3,950,001 A | | 4/1976 | Weigl | |
| 3,966,218 A | | 6/1976 | Beyl | |
| 4,186,500 A | | 2/1980 | Salzman | |
| 4,266,806 A | | 5/1981 | Weigl et al. | |
| 4,273,355 A | | 6/1981 | Storandt | |
| 4,310,170 A | | 1/1982 | Linecker | |

(Continued)

FOREIGN PATENT DOCUMENTS

AT 327066 1/1976

(Continued)

*Primary Examiner* — Katy M Ebner
(74) *Attorney, Agent, or Firm* — Knobbe Martens Olson & Bear, LLP

(57) ABSTRACT

The present invention relates to a spring cartridge for a ski binding, wherein the ski binding has a rotatable front binding part for attachment of a ski boot, and is in particular a telemark ski binding. In the binding the spring cartridge provides tension to a biasing cable which biases the rotatable front binding part, so as to rotate the front binding part so that an attached ski boot would be brought into contact with the ski to which the ski binding is attached.

The spring cartridge comprises an extended hollow housing open at both ends, a compression spring held within the extended hollow housing and a pressure stub held partly within the compression spring.

The pressure stub is structured with an extended portion having a cross dimension smaller than the interior size of the compression spring and a head having a larger size than the interior size of the compression spring. The extended portion extends within the internal hollow of the compression spring and is also hollow and provided with an internal screw thread in the hollow section for threadable engagement with an external screw thread at the end of a biasing cable of a ski binding, the biasing cable being threadable through the center of the compression spring to the pressure stub.

With rotation of the pressure stub this would thus lead to a change in the amount of the biasing cable held within the hollow section, when present, and thus change the amount of compressive force acting on the compression spring.

13 Claims, 3 Drawing Sheets

U.S. PATENT DOCUMENTS 4,322,090 A 3/1982 Loughney
4,522,424 A 6/1985 Luitz et al.
4,524,990 A 6/1985 Svoboda et al.
4,571,858 A 2/1986 Faulin
4,722,613 A 2/1988 Jungkind
4,772,041 A 9/1988 Klosterman et al.
4,887,833 A * 12/1989 Bailey ..... 280/615
4,955,633 A 9/1990 Stritzl et al.
5,088,756 A 2/1992 Hue et al.
5,116,073 A 5/1992 Goud et al.
5,125,680 A 6/1992 Bejean et al.
5,143,395 A 9/1992 Mayr et al.
5,190,309 A 3/1993 Spitaler et al.
5,211,418 A 5/1993 Scherubl
D345,454 S 3/1994 Hauglin
5,344,178 A 9/1994 Rohrmoser
5,344,179 A 9/1994 Fritschi et al.
5,356,169 A 10/1994 Hue et al.
5,366,235 A * 11/1994 Eugler et al. ..... 280/622
5,480,175 A 1/1996 Astier et al.
5,484,149 A 1/1996 Lee
5,498,017 A 3/1996 Rohrmoser
5,499,838 A * 3/1996 Hauglin et al. ..... 280/615
5,671,941 A 9/1997 Girad
5,732,968 A 3/1998 Wladar et al.
5,765,854 A 6/1998 Moore et al.
5,893,576 A * 4/1999 Hauglin ..... 280/621
5,897,127 A 4/1999 Hauglin
5,899,006 A 5/1999 Donnadieu
5,924,719 A 7/1999 Girard
5,944,336 A 8/1999 Fagot
5,944,337 A 8/1999 Girard et al.
5,947,507 A * 9/1999 Quintana et al. ..... 280/615
6,017,050 A 1/2000 Girard
6,065,895 A 5/2000 Lehner et al.
6,092,829 A 7/2000 Mercier
6,209,903 B1 4/2001 Girard
6,216,366 B1 4/2001 Donnadieu
6,234,514 B1 * 5/2001 Dubuque ..... 280/619
6,289,610 B1 9/2001 Girard et al.
6,315,318 B1 11/2001 Caron et al.
6,374,517 B2 4/2002 Girard et al.
6,390,493 B1 * 5/2002 Hauglin ..... 280/615
6,402,184 B1 6/2002 Hauglin
6,450,510 B1 9/2002 Liu
6,471,235 B1 10/2002 Luitz et al.
6,499,761 B1 12/2002 Quellais
6,547,261 B2 4/2003 Gorza et al.
6,588,791 B1 7/2003 Hom
6,612,592 B1 9/2003 Soo
D488,294 S 4/2004 Lancon
6,814,367 B2 11/2004 Mercier et al.
6,824,158 B1 11/2004 Keller et al.
7,036,842 B2 5/2006 Krumbeck et al.
7,207,591 B2 4/2007 Riedel et al.
7,216,888 B1 5/2007 Walker et al.
7,216,890 B2 * 5/2007 Walker et al. ..... 280/619
7,219,917 B2 * 5/2007 Walker et al. ..... 280/613
7,246,812 B1 * 7/2007 Ayliffe ..... 280/615
7,264,263 B2 9/2007 Riedel et al.
7,384,057 B2 * 6/2008 Steffen et al. ..... 280/611
7,681,905 B2 * 3/2010 Hauglin ..... 280/615
2003/0155742 A1 8/2003 Riedel et al.
2004/0164519 A1 8/2004 Quellais et al.
2004/0207177 A1 10/2004 Riedel et al.
2004/0262886 A1 12/2004 Girard
2007/0108735 A1 * 5/2007 Walker et al. ..... 280/611
2007/0108736 A1 * 5/2007 Walker et al. ..... 280/619
2007/0108737 A1 * 5/2007 Walker et al. ..... 280/619
2007/0108738 A1 * 5/2007 Walker et al. ..... 280/620
2007/0126204 A1 6/2007 Riedel et al.
2008/0042401 A1 * 2/2008 Walker et al. ..... 280/615
2008/0127523 A1 6/2008 Hauglin

FOREIGN PATENT DOCUMENTS

AT 354306 B 1/1980
CH 557154 12/1974
DE 1929885 12/1965
DE 24 18 577 A 10/1975
DE 26 45 007 10/1976
DE 27 14 853 A 10/1978
DE 27 28 747 A 1/1979
DE 3113942 A1 10/1982
DE 3222132 A1 12/1983
DE 37 85 420 T2 6/1987
DE 3838569 6/1989
DE 3924939 A1 5/1990
DE 4229039 4/1993
DE 93 20 530 10/1994
DE 195 17 791 A1 5/1995
DE 200 07 032 U1 9/2000
DE 102004023832 11/2002
DE 10124893 11/2003
DE 102004018296 A1 2/2005
DE 10319675 6/2005
EP 0029206 A 5/1981
EP 0787440 8/1997
EP 0 820 790 A 1/1998
EP 0878218 11/1998
EP 0 908 204 A2 4/1999
EP 0 951 926 A 10/1999
EP 1240925 9/2002
FR 2569119 2/1986
FR 2 556 188 A1 12/1993
FR 2 741 543 5/1997
FR 2 742 060 6/1997
FR 2 803 178 A1 12/1999
NO 319592 7/2003
WO WO 88/04563 6/1988
WO WO 96/23558 8/1996
WO WO 01 66204 A 9/2001
WO WO0249728 6/2002
WO WO03/101555 12/2003
WO WO2004/045728 6/2004

* cited by examiner

SPRING CARTRIDGE FOR SKI BINDING

CROSS REFERENCE TO RELATED APPLICATIONS

This application claims the benefit and priority to European Patent Application Number 08155169, filed on Apr. 25, 2008. The disclosures of the above-referenced application is hereby expressly incorporated by reference in its entirety.

BACKGROUND

1. Field

The invention relates to a ski binding and, more particularly, a spring cartridge to adjust biasing force acting on a ski binding.

2. Description of the Related Art

Skiing is a very popular pastime and enjoyed by a great many people. A variety of different skiing styles and disciplines exist, one particular form being touring skiing. In touring skiing, a ski is provided with a special binding which allows rotation of the ski boot relative to the plane of the ski. Typically, the front part of the ski boot is attached by means of the rotatable binding part of the ski binding, with the heel of the boot being free to move up and round out of the plane of the ski. Such skiing is often called telemark skiing. Telemark ski bindings allow the skier to bring the heel of the boot off the surface of the ski, and is thus useful for ski touring. In such a discipline, the skier uses the ski to walk up the side of the ski slopes, and thus requires that the ski boot can rotate relative to the ski.

As is clear from the above, providing a rotatable section to the ski binding for allowing the ski boot to rotate with respect to the ski, must be done under controlled conditions. Free rotation of the ski relative to the boot is undesirable, and thus it is necessary to provide a biasing force on the ski boot or binding such that the ski boot will generally be biased back into contact with the ski. With this biasing acting upon the rotatable section of the binding, free rotation of the ski is avoided, and the skier has much more control over the movement of the ski relative to the boot. Additionally, the biasing means can be used to provide a maximum rotation of the boot compared with the ski, which also improves the control in the technique.

Typically, a telemark binding will be provided with some sort of cable which provides the biasing for repositioning the rotatable section of the ski binding back into contact with the main portion of the ski binding, such that the boot is drawn back into contact with the ski. This biasing cable is usually fixed to the ski binding such that it passes from the stationary, or main part of the binding, which is left in contact with the ski, through to the rotatable part of the binding. By providing some sort of tensioning means to the cable, the cable can allow rotation of the rotatable binding part, whilst also ensuring that the restorative force then acts to bring the rotatable binding part back into its rest position. Generally, some sort of spring element is provided attached between the cable and one part of the ski binding, wherein the spring element allows the cable to move with respect to a spring, either compressing or stretching a spring thus adding the restoration or biasing force by means of the spring elements.

Known systems of spring elements require the specific use of tools in order to adjust the amount of tension the spring provides to the cable. It is important to be able to adjust the restoring force provided by the cable, as the binding may be used by different people or in different conditions. One restorative force is suitable for certain conditions and certain skiers, but not necessarily for different skiers or conditions. Typically, it is not easy to change the restorative force acting on the cable from the spring, thus impacting on the enjoyment to the skier.

The present disclosure presents a simple system by which the restorative force acting on the biasing cable can be adjusted in a simple manner.

SUMMARY OF THE INVENTION

The present invention provides a spring cartridge for a ski binding in accordance with independent claim 1. Further preferred embodiments are given in the dependent claims.

The claimed invention can be better understood in view of the embodiments of the spring cartridge described hereinafter. In general, the described embodiments describe preferred embodiments of the invention. The attentive reader will note, however, that some aspects of the described embodiments extend beyond the scope of the claims. To the respect that the described embodiments indeed extend beyond the scope of the claims, the described embodiments are to be considered supplementary background information and do not constitute definitions of the invention per se. This also holds for the subsequent "Brief Description of the Drawings" as well as the "Detailed Description of the Preferred Embodiments."

In particular, the present disclosure relates to a spring cartridge for use in a ski binding. As discussed above, the ski binding is typically provided with a specific rotatable section, wherein the rotatable section is designed for attachment of a ski boot. The rotatable section of the ski binding is positioned such that the front section of the ski boot will be attached thereto, and the heel of the boot will be free to rotate from a position in and out of contact with the ski. Such a ski binding is typically referred to as a telemark ski binding. In such a ski binding, a biasing or tensioning cable is provided and is used to add a biasing force to the rotatable section of the binding, wherein the biasing force acts to bring the rotatable section back into contact with the main part of the ski binding. By providing such a biasing force in this manner, the heel of a ski boot would be brought back into contact with the ski binding or ski to which the ski binding is attached.

In particular, the spring cartridge is provided by an extended hollow casing section, into which a spring is provided. Such a spring is a compression type of spring, which has a specific length at rest, and will act to return to this length when it is stretched or compressed. Further features of the spring cartridge are that the extended hollow housing is provided with holes at either end thereof, and the spring is held within the housing such that the centre of the spring will advantageously align with the holes of the housing. A final feature of the spring cartridge is that of a bolt-like element, or pressure stubs; the pressure stub is structured such that it comprises an elongate section which is small enough to fit within the central hollow of the compression spring, and a head section which is too large to fit within the compression spring and thus rests against one end of the spring.

In use, the spring cartridge is fashioned such that the spring is held within the extended hollow section, and the pressure stub is provided with its extended section threaded through one end of the compression spring. The spring cartridge is then intended to be used with a ski binding as discussed above, wherein a biasing cable threads through the hole of the extended hollow housing opposite the hole by the pressure stub. The biasing cable will then pass through the centre of the compression spring up to the pressure stub, and be attached thereto. The end of the biasing cable is preferably provided with a screw thread, and the extended section of the pressure stub is hollow and has a matching internal thread. Clearly, therefore, the threaded end of the biasing cable can be threadably engaged with the internal thread on the pressure stub, and thus held by the pressure stub within the compression spring and spring cartridge.

In such an orientation, it is clear that movement of the biasing cable out of the spring cartridge will lead to a compression of the compression spring. When the spring cartridge is mounted appropriately within a ski binding, this arrangement of the biasing cable and spring cartridge will lead to the required restorative force acting on the rotatable section of the binding. Another advantageous feature of the spring cartridge design, is that rotation of the pressure stub will lead to more or less of the biasing cable held within the extended hollow portion of the pressure stub. Rotating the stub such that more of the cable is threadably engaged, will lead to more of the cable being drawn into the spring cartridge; clearly, rotation the other way will lead to less of the biasing cable held within the spring cartridge. As the position of the spring cartridge and other end of the biasing cable, which will be attached to the other section of the ski binding not housing the spring cartridge if fixed: changing the amount of cable held within the pressure stub will lead to an increased basic compression of the compression springs. In this scenario, it is therefore clear that rotation of the pressure stub will change the restorative force and bias on the biasing cable, and thus change the properties of the binding.

A further advantageous feature of the spring cartridge, is that it can be provided with a rotatable adjustment device or knob. This rotatable device can be fashioned such that it would interact with the pressure stub and allow rotation of the stub thus allowing adjustment of the compression of the compression spring, and thus the restorative force. If the adjustable knob is provided at the other end of the spring cartridge from the hole in which the biasing cable is to be threaded, it is positioned at the correct end to interact with the pressure stub. Further, by fashioning the head of the pressure stub with a specific engagement portion, and having the internal section of the adjustment knob with the relevant mating structure, when the pressure stub is held next to the adjustable knob, by means of the compression spring pushing it there, rotation of the adjustment will lead to mating of these two mating structures and thus eventually the pressure stub and adjustable knob will rotate as one.

Advantageously, the first of the two mating structures could be provided by means of a slot on the adjustable knob held within the spring cartridge. By fashioning the entire head of the pressure stub such that it fits exactly within this slot, will thus lead to the appropriate mating engagement.

It is further advantageous if the spring cartridge is generally cylindrical in shape. This is best achieved by providing the extended hollow housing with a hollow cylindrical shape, and thus the adjustment knob would also be generally circular so as to match this. This has further advantages, in that the spring will almost certainly be cylindrical in shape, and thus the spring cartridge can be chosen with a diameter which is roughly the same as the compression spring, such that no relative motion between the two exists.

In order to ensure that the spring is maintained in the spring cartridge, the extended hollow housing can be provided with a reduced size at either end thereof. By providing the reduced size next to the holes either end of the extended hollow housing, a simple mechanism of keeping the compression spring and pressure stub within the spring cartridge is achieved. That is, by ensuring that the holes at either side of the spring cartridge are smaller than the external size of the spring and pressure stub, will ensure that these cannot pass through either hole and are maintained within the spring cartridge.

The rotatable adjustment knob is intended to have a part held within the spring cartridge and also a section which is outside of the extended hollow housing. The adjustable knob would thus allow the user of the ski binding to easily adjust the tension of the biasing cable and restorative force acting thereon as the adjustment knob could easily be reached and turned. Joining the external section and internal section would obviously be a section of reduced cross-sectional size, wherein this cross-sectional is approximately the same as the hole at the end of the extended hollow housing. In this way, the adjustable knob can be held within this hole at the end of the extended hollow housing, and thus form part of the spring cartridge.

Advantageously, the section of the rotatable knob held outside of the extended hollow section could be provided with a rim on which a plurality of teeth are given. By structuring the rim of the accessible part of the adjustable knob will improve the ease by which a user of the ski binding can adjust the tension acting on the biasing cable. Alternatively or in addition to this hand-adjustable system, a slot or cross for receiving a screwdriver can also be provided. This would allow for two ways of adjusting the tension on the biasing cable, and thus improve the ease of use of the spring cartridge and ski binding in general.

A further advantageous feature of the spring cartridge, is to structure the rotatable adjustment knob with either an indent or protrusion thereon. Such an indent or protrusion would interact with a mating protrusion or indent, respectively, provided on either the extended hollow housing of the spring cartridge itself, or on the section of the ski binding to which the spring cartridge is engaged. It is advantageous for the skier to have some indication how many rotations of the adjustable knob have been made, and this system provides a tangible indication of such. Obviously with rotation of the adjustable knob, the indents and protrusions on the adjustable knob and extended hollow section or ski binding will engage and disengage, and the skier will have a clear tactile indication of the amount of rotation. If, for example, two protrusions or indents are provided on the adjustable knob and two indents or protrusions, respectively, are provided on the ski binding or extended hollow section, every 180° of rotation of the adjustable knob will lead to engagement and a click or step-like motion to the adjustable knob. That is, the rotation of the adjustable knob is provided in a click-wise manner, such that rotation leads to a clicking sensation when the indents and protrusions align. Obviously, any number of such indents or protrusions can be provided, and whilst two will lead to 180° rotation sensation, four would obviously lead to 90° and so forth. Provision of a tactile indication of the amount of rotation leads to a significant improvement in the skiers feeling of how many rotations have been made, and thus will allow for more accurate changing of the amount of tension and restorative force acting on the biasing cable.

A further aspect of the present disclosure relates to a ski binding for use with the spring cartridges as described above. In particular, such a ski binding will be provided with a biasing cable between the rotatable ski binding part and a main section which remains fixed to the skis. The biasing cable is attached to one of the sections of the ski binding and by means of the spring cartridge described above is attached in a tensioning manner to the other section of the ski binding. With rotation of the rotatable section of the ski binding the cable is drawn out of the spring cartridge, and thus by means of the pressure stub will act against the compression spring. With further rotation the compression spring is further compressed, and this leads to a change in the restorative force. With this in mind, it is clear then that rotation of the pressure stub will lead to a change in the base compression of the compression spring, which will thus also change the restorative force acting on the rotatable binding part.

It is possible to have the cable fixed to the main section of the ski binding, and for this to pass through to the spring cartridge which is fixed at the rotatable part of the binding. Likewise, it is equally possible to have this situation reversed, wherein the rotatable section of the binding is provided with the fixed end of the biasing cable, and that the main section of the binding attached to the ski is provided with the spring cartridge. In both of these options, rotation of the rotatable part of the binding will still lead to the cable being drawn out of the spring cartridge and compression of the compression spring, and thus generation of the required restorative force.

A further design of the ski binding would be to provide two spring cartridges as defined above. If two spring cartridges are provided such that they face the same way, and are generally parallel, a biasing cable can be threaded between both of these cartridges. If the biasing cable then loops around a fixed part of the ski binding, provided on the other section of the ski binding from that of the spring cartridges, rotation of the rotatable binding part will lead to the cable moving with respect to both spring cartridges. That is, the cable will be generally pulled out of both spring cartridges and lead to the compression of two compression springs by means of each pressure stubs. It is conceived that the rotatable binding part can be structured to house two of the spring cartridges described above, and that a single biasing cable passes from one to other of the spring cartridges around a looping post provided on the main section of the binding. Rotation of the rotatable part of the ski binding will lead to both ends of the biasing cable being drawn through both of the spring cartridges, as the looped section is maintained in a stationary position within the ski binding. In this way, the restorative forces provided by two compression springs, and thus the strength of the compression spring can be reduced slightly and the ease of manufacture of the spring cartridge improved.

If the above dual cartridge design is provided, it is also possible to have the looping post releasibly mounted to the ski binding. In this way, it is then possible to move the looping post with respect to the spring cartridges, and thus remove any tension acting on the biasing cable. By removing the tension acting on the biasing cable, this will ensure that the pressure stub is pushed into engagement with the rotatable knob on the inside of the extended hollow section of the spring cartridge. Without the tension on the cable, it is a lot easier for the use of the ski to rotate the adjustable knob, again preferably in a click-wise manner, and thus adjust the restorative force provided by both spring cartridges.

BRIEF DESCRIPTION OF THE DRAWINGS

FIGS. 1(*a* and *b*) show a spring cartridge with many of the features of the present disclosure.

DETAILED DESCRIPTION

Figures 1A, 1B:
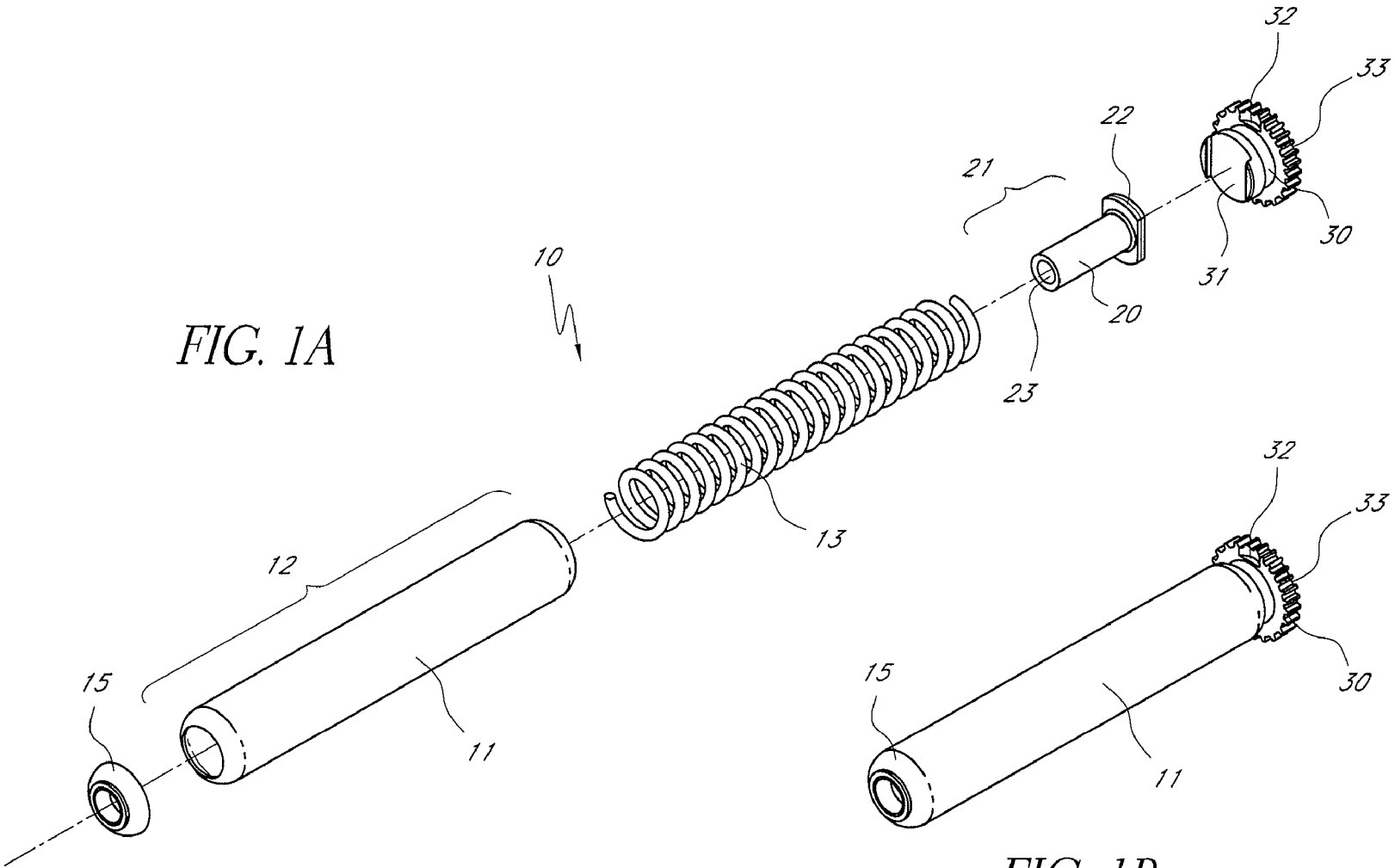
FIG. 1*a* is an exploded view of the complete cartridge shown in FIG. 1*b*.
Figure 2A:
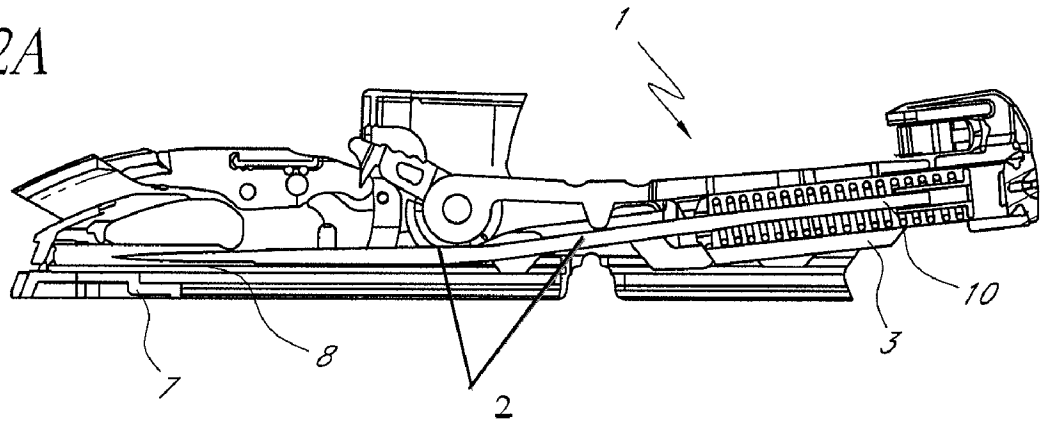
FIG. 2*a* shows a cross-section through a ski binding shown in FIG. 2*b*. The ski binding has the spring cartridge shown in FIGS. 1*a* and 1*b*.
Figure 2B:
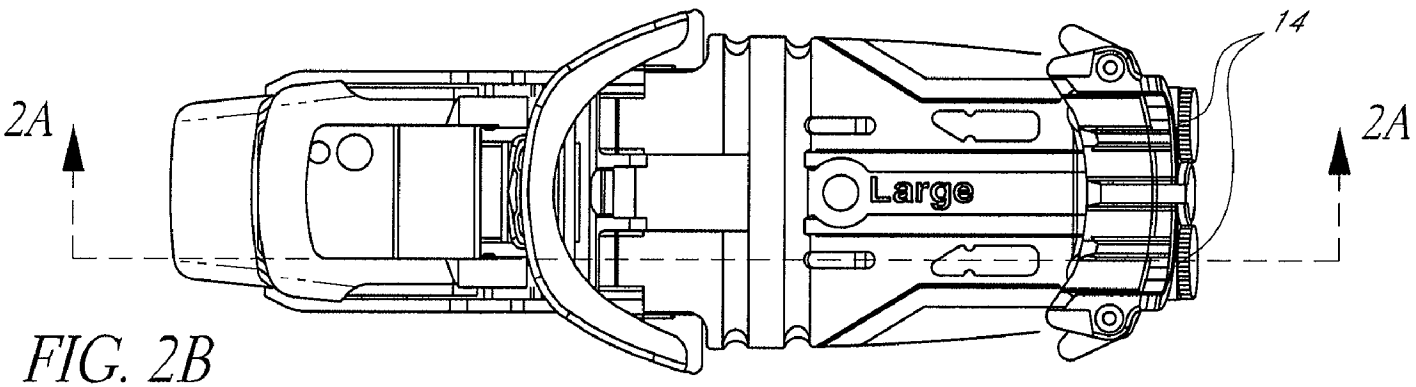
Figure 3A:
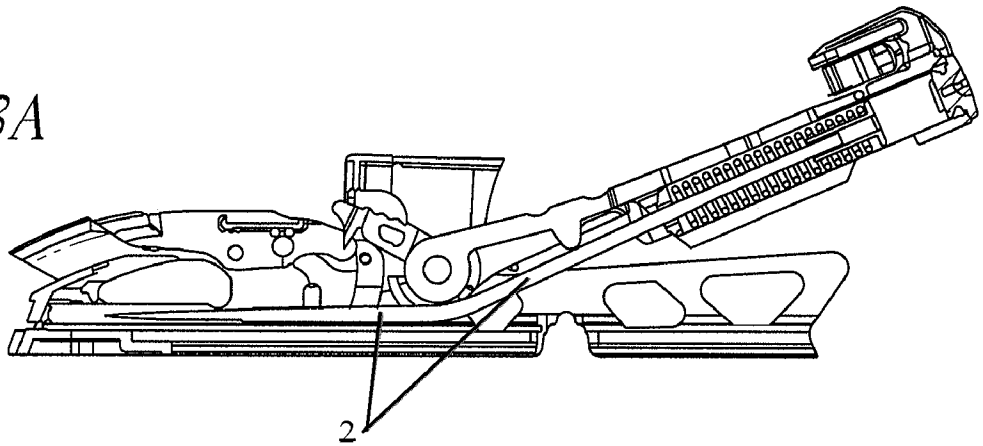
FIGS. 3*a* and 3*b* shows the ski binding of FIGS. 2*a* and 2*b*, wherein part of the ski binding has been rotated so as to show the effect on the spring cartridge.
Figure 3B:
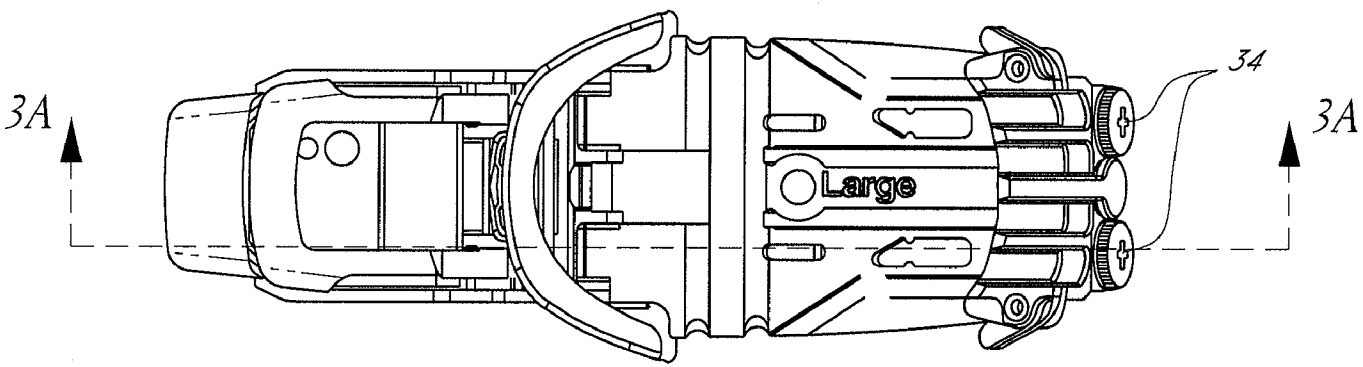

Looking at FIGS. 1*a* and 1*b*, many of the key features of the spring cartridge 10 of the present disclosure can be seen. Such a spring cartridge 10, is designed and structured for use with a ski binding 1. Ski binding 1 such as those shown in FIGS. 2 and 3, are typically associated with telemark skiing, in which the binding 1 has two distinct sections. A first rotatable front binding part 3, is provided with an appropriate fixing mechanism and structures to allow connection of the ski boot 4 of a skier. In this particular form of skiing, it is necessary for the ski boot 4 to be fastened in a rotatable manner to the ski binding 1, such that the back of the ski boot 4 can be lifted and rotated away from the ski 5. Whilst in FIGS. 2 and 3 the ski 5 is not shown, the ski binding 1 is intended to be fitted onto the top surface of the ski 5, in the usual manner.

In addition to the rotatable front binding part 3 as shown in FIGS. 2 and 3, the ski binding 1 also comprises a main part 7. This main part 7, remains stationary with respect to the ski 5 when the ski 5 is in use. The rotatable front binding part 3 is rotatably mounted to the main part 7 of the ski binding 1, and therefore allows the skier to rotate their ski boot 4 out of contact with the ski binding 1 by means of rotation.

In order to control the rotation action of the rotatable front binding part 3 in relation to the main part 7 of the ski binding 1, it is necessary that some rotation limiting means and general biasing means is provided. Such a biasing means is often provided by means of a biasing cable 2, as can be seen in FIGS. 2 and 3. From these figures, it is clear that the biasing cable 2 is provided between the rotatable front binding part 3 and the main part 7 of the ski binding 1. As can be seen in FIG. 2, the biasing cable runs from the main part 7 to be fixed to the rotatable front binding part 3 by means of the spring cartridge 10 as shown in FIGS. 1*a* and 1*b*, and as further described below. Wherein the spring cartridge 10 provides a biasing force onto the biasing cable, as will also be described below.

Obviously, the example shown in FIGS. 2 and 3 wherein the spring cartridge 10 is mounted to the rotatable front binding part 3, is only one of several possibilities. For example, it is equally possible to provide the biasing cable 2 directly attached to the rotatable front binding part 3. In this scenario, the other end of the biasing cable 2 will be attached to the spring cartridge 10, wherein the spring cartridge 10 is attached to the main part 7 of the ski binding 1. Obviously, these two possibilities lead to the same advantage, in that the biasing cable 2 is affixed at one end to one part of the ski binding 1, and at the other end by means of the spring cartridge 10 to the other part of the ski binding 1.

A particularly preferred embodiment is shown in both FIGS. 2 and 3, wherein two spring cartridges 10 are provided with a looped biasing cable 2 passing from one to the other. The biasing cable 2 in this particular design passes from the first spring cartridge 10 through and round a looping post 8 provided on the main part 7 of the ski binding 1. After looping round the looping post 8, the biasing cable 2 passes to the second spring cartridge 10 and is attached thereto. The looping post 8 is provided in a releasable manner in the main part 7 of the ski binding 1, and when the ski binding 1 is in use, the looping post 8 is maintained in the same position. After release of the looping post 8, this can be moved back and forth in the direction from left to right as seen in FIGS. 2 and 3, that is in the direction closer to the spring cartridges 10. By releasing and moving the looping post 8, the tension in the biasing cable 2 can be removed, which as will be described in detail below, allows for attachment of the biasing cable 2 to the spring cartridge 10, and also allows for the compression provided by the spring cartridge 10 to be adjusted. After the adjustments have been made to the biasing cable 2, the looping post 8 is returned to its original configuration, as shown in FIGS. 2 and 3, which returns the basic tension to the biasing cable 2 and allows the operation of the ski binding 1. It is intended that the releasable mounting of the looping post 8 be done by means of a manually operable system requiring no tools. For example, providing a lever attached to the looping post 8 which can be hand operated to slide the looping post 8 backward and forward.

As is disclosed above, the spring cartridge 10 as shown in FIGS. 1*a* and 1*b* is used to attach to one end, or in some examples two ends, of the biasing cable 2 in such a way as to allow some movement of the end of the biasing cable 2 attached to the spring cartridge 10, whilst also generating a restorative force to return the end of the biasing cable 2 to its original point within the spring cartridge 10. As can be seen in combination with FIGS. 2 and 3, the spring cartridge 10 allows the end of the biasing cable 2 to move within the spring cartridge 10, thus allowing the rotation of the rotatable front binding part 3. With rotation of the rotatable front binding part 3, the end of the biasing cable 2 held within the spring cartridge 10 and some of the biasing cable 2 is drawn-out of the spring cartridge 10. This can be seen when FIGS. 2 and 3 are compared, wherein less of the biasing cable 2 is within the spring cartridge 10 in FIG. 3. Clearly, if a restorative force is applied onto the biasing cable 2 as shown in FIG. 3, the biasing cable 2 by means of a spring cartridge 10 will lead to the rotation of the rotatable front binding part 3 back to the orientation in FIG. 2, which is the point where the ski boot 4 is back in contact with the ski binding 1 and the ski 5.

Looking at FIG. 1*a*, it is quite clear how the spring cartridge of the present disclosure is structured. In this case, the spring cartridge 10 is provided with an extended hollow housing 11 which forms the outer surface of the spring cartridge 10. In the embodiment shown in FIGS. 1-3, the extended hollow housing 11 is cylindrical in shape. The external shape of the spring cartridge 10 is not limited to that of the cylinder, and indeed a square or other cross-sectional shaped hollow tube would also function equally well. As is clear from FIG. 1*a*, both ends 12 of the extended hollow housing 11 are open, wherein the holes are preferable provided with a size which is approximately the same as the cross-sectional size of the biasing cable 2.

Positioned within the extended hollow housing 11 of the spring cartridge 10, is a compression spring 13. Such a compression spring 13 is one which has a slightly elongated spring structure, and which will generate a restorative force to try and return it to its normal length, when the spring is either extended or compressed. It is preferable for the compression spring 13 to have a natural rest length which is approximately the same as the length of the extended hollow housing 11. Clearly, the external size of the compression spring 13 is smaller than the internal size of the extended hollow housing 11, such that the compression spring 13 can fit therein. As is shown in the figures, the two ends 12 of the extended hollow housing 11 can be provided with some form of chamfering, such that the size of the hole is smaller than the external size and internal size of the extended hollow housing 11. This is an advantageous feature to the extended hollow housing 11, but provides a simple way of keeping the compression spring 13 within the extended hollow housing 11 without additional means. A further feature which can be seen in the exploded view of FIG. 1*a*, is that of a bushing 15 provided at one end of the extended hollow housing 11. This bushing 15 is optional, but does provide a point at which the end of the compression spring 13 can act against. Further, the bushing 15 is provided at the end of the extended hollow housing 11 into which the biasing cable 2 will be threaded, as described in more detail below, and thus also provides a guide for the biasing cable 2.

In order to fix the end of the biasing cable 2 within the spring cartridge 10, a pressure stub 20 is provided. As can be seen in FIG. 1*a*, this pressure stub 20 is provided with an approximately bolt-shape. That is, the pressure stub 20 has an extended portion 21 which is small enough to fit within the interior of the compression spring 13. Furthermore, the pressure stub 20 has a head 22, which will not fit within the interior of the compression spring 13, and will thus provide a surface for interacting with the compression spring 13. As has been discussed above, the biasing cable 2 passes through the hole at the end 12 of the extended hollow housing 11; additionally, the biasing cable 2 will pass through the central hollow section of the compression spring 13, and will then reach the pressure stub 20. Providing the extended portion 21 of the pressure stub 20 to be hollow, allows the biasing cable 2 to be attached to the pressure stub 20. By providing the biasing cable 2 with an end that has an external screw thread, and providing the hollow section 23 of the extended portion 21 with an internal matching screw thread, the end of the biasing cable 2 can be screwed into the hollow section 23 of the extended portion 21. Once the biasing cable 2 has been threadably engaged with the pressure stub 20, it is clear that pulling on the biasing cable 2 will cause the pressure stub 20 to compress the compression spring 13. With such compression, this restorative force of the compression spring 13 will act to pull biasing cable 2 back through the spring cartridge 10 until the compression spring 13 has returned to its normal length.

As is clear from FIGS. 2 and 3, and from the discussion above, the biasing cable 2 is usually fixed at one end to the ski binding 1 at some point, and then fixed at the other end as disclosed above to the spring cartridge 10. Furthermore, the spring cartridge 10 is fixed in the ski binding 1 either in the rotatable front binding part 3 or the main part 7. As such, only a limited length of biasing cable 2 is required, and this is typically chosen so as to be the correct length for passing from the one fixed point through to the pressure stub 20 in the spring cartridge 10. With rotation of the rotatable front binding part 3, the biasing cable 2 will pull against the pressure stub 20 as the distance between the fixing point of the biasing cable 2 on the ski binding 1 and the natural end of the compression spring 13 changes. This is as seen clearly between FIGS. 2 and 3. In this embodiment, it is clear that the biasing cable 2 is fixed and must pass round a bend shown and provided by a point of the ski binding 1 lying close to the rotation axis of the rotatable front binding part 3. By bending the biasing cable in this manner, it is clear that rotation of the rotatable front binding part 3 will lead to the cable 2 not being long enough to reach the end of the compression spring 13, and will thus draw the pressure stub 20 along the interior of the extended hollow housing 11 thus compressing the compression spring 13. The same principle as described above would work when the spring cartridge 10 is mounted to the main part 7 of the ski binding 1, and the biasing cable 2 is attached to the rotatable front binding part 3.

In the other described example, wherein a loop of biasing cable 2 is provided, with rotation of the rotatable front binding part 3, the length of biasing cable 2 will not be sufficient to reach to the natural end of the compression spring 13. A rotation of the rotatable front binding part 3 will lead to the ends of the biasing cable 2 in the spring cartridge 10 pulling on the pressure stub 20 and thus compressing the compression spring 13. Again, this is shown as being advantageously affected by having a bend in the biasing cable 2 approximately located at the rotation axis of the rotatable front binding part 3.

In consideration of the threadable engagement between the end of the biasing cable 2 and the pressure stub 20, it is clear that it is possible to change the strength of the restoring force provided by the compressed compression spring 13. Rotation of the pressure stub 20 will lead to more or less of the biasing cable 2 being housed within the hollow section 23 of the extended portion 21. Rotation of the pressure stub 20 such that more of the biasing cable 2 is held within the hollow section 23, will lead to a shorter biasing cable 2 length and thus it is possible for the biasing cable 2 to more fully compress the compression spring 13. In this manner, the rotation of the rotatable front binding part 3 will lead to a more significant compression of the compression spring 13, which will also increase the restorative force provided by the compression spring 13, which will then be felt by the user of the ski 5. As such, this system allows for a simple mechanism of adjusting the restorative force and feel of the ski binding 1.

It is possible to provide the spring cartridge 10 in the manner described above, and use a screwdriver or other tool to interact with the pressure stub 10 to increase or decrease the amount of biasing cable 2 held in the hollow section 23 of the extended portion 21. An advantageous further possibility is that shown in FIG. 1*a*, wherein a rotatable adjustment knob 30 is also provided in the spring cartridge 10. This rotatable adjustment knob 30 is positioned at the end 12 of the spring cartridge 10 which does not accept the biasing cable 2. That is, the rotatable adjustment knob 30 is provided at the pressure stub 20 end of the compression spring 13. If the rotatable adjustment knob 30 is provided with a section which fits within the standard hollow housing 11 of the spring cartridge 10, it is possible to use this internal part to interact with the pressure stub 20 and allow rotation thereof. By providing a first mating structure on this interior portion of the rotatable adjustment knob 30, and an appropriately matching section on the pressure stub 20, these two can matably engage and rotation of the rotatable adjustment knob 30 will lead to a rotation of the pressure stub 20. Obviously the rotation of these two elements will lead to more or less of the biasing cable 2 being threadably engaged within the hollow section 23 of the extended portion 21, and will also lead to a change in the compression characteristics of the spring cartridge 10 and compression spring 13.

As can be seen in the figures, a simple mechanism of providing the two engagement mechanisms on the rotatable adjustment knob 30 and pressure stub 20 is to provide a slot on the rotatable adjustment knob 30. This slot is provided in the section within the extended hollow housing 11, and is structured to be the same size and shape as the head 22 of the pressure stub 20. That is, when all tension has been taken off the compression spring 13, the pressure stub 20 will rest against the rotatable adjustment knob 30, and thus with a rotation of the rotatable adjustment knob 30 the head 22 of the pressure stub 20 will engage with the slot 35 on the rotatable adjustment knob 30, and then these two will rotate as one. As was described above, by allowing movement of either a looping post 8 or the fixing point of the biasing cable 2 with the ski binding 1, the pressure on the compression spring 13 can be removed, which will then allow internal engagement of the pressure stub 20 and rotatable adjustment knob 30.

In order to improve the usability of the rotatable adjustment knob 30, it is possible to provide teeth on the outer rim of the rotatable adjustment knob 30. This will allow the user of the ski 5 and binding 1 to adjust the compressive force acting on the compression spring 13 by means of his or her hand. Alternatively, some form of indent can be provided on the rotatable adjustment knob 30 such that a screwdriver or other simple tool could be used to allow rotation of the rotatable adjustment knob 30.

A further advantageous feature is to provide the rotatable adjustment knob 30 with either an indent or indents or one of more protrusions so as to provide a step-wise feel to the rotation of the rotatable adjustment knob 30. Providing one or more indents or one or more protrusions on the rotatable adjustment knob 30 will allow these to interact with one or more protrusions or one or more indents 14, respectively, provided on either the extended hollow housing 11 or some section of the ski binding 1. As shown in FIGS. 2 and 3, in particular the plan views of these figures, a protrusion on the rotatable front binding part 3 has been provided, and this interacts with an indent 32 on the rotatable adjustment knob 30. Obviously, the inverse is possible, wherein an indent 14 is provided on the rotatable binding part 3 and a protrusion 32 is provided on the rotatable adjustment knob 30. By providing these interacting indents and protrusions 14, 32 rotation of the rotatable adjustment knob 30 will lead to a click-wise or rotationally stepped rotation. That is, it is clear that the rotation of the rotatable adjustment knob 30 will lead to the indents and protrusions 14, 32 interacting with each other, and every time these line up there will be a click or stepping sensation to the user, showing that a certain rotation degree has been obtained. It is conceived that two indents and protrusions 14, 32 are provided, such that rotation of the rotatable adjustment knob 30 by 180° will lead to alignment of the indents and protrusions 14, 32, such that the click or step is noticed by the user of the ski binding 1. Such a click-wise change will allow the user to determine how far he or she has rotated the rotatable adjustment knob 30, which will allow for presetting of the amount of tension provided on the compression spring 13. Of course any number of protrusions and indents 14, 32 is possible, to give a different number of clicks per 360° of rotation.

As can be seen from FIG. 1*a*, the rotatable adjustment knob 30 is provided with a middle section which is slightly reduced in size. This middle section is intended to be approximately the same size as the hole provided at the end 12 of the extended hollow housing 11, thus housing and keeping the rotatable adjustment knob 30 at the end 12 of the extended hollow housing 11. That is, the external section has the size which is larger than the hole at the end 12 of the extended hollow housing 12, and also the interior section provided with the engagement portion, also has a larger size than the hole at the end 12 of the extended hollow housing 11, such that the rotatable adjustment knob 30 is fixed at the end 12.

Whilst a variety of different options have been given for the spring cartridge 10 and ski binding 1, no combination is presented as being particularly required. As is clear, the spring cartridge 10 can be provided and mounted at a variety of locations on the ski binding 1, and is provided merely in order to interact with one end of a biasing cable 2. Further, by means of the compression spring within the spring cartridge 10, the spring cartridge 10 provides a restorative and biasing force onto this biasing cable 2. By providing the screw thread attachment into the pressure stub 20 of the spring cartridge 10, the compression force on the compression spring 13 can be easily adjusted as required by the user. The full scope of the present disclosure is defined in the attached claims.

What is claimed is:

1. A spring cartridge for a ski binding having a rotatable front binding part for attachment of a ski boot, in particular a telemark ski binding, the spring cartridge providing tension to a biasing cable which biases the rotatable front binding part, so as to rotate the front binding part so that an attached ski boot would be brought into contact with the ski to which the ski binding is attached, the cartridge comprising:

an extended hollow housing open at both ends, a compression spring held within the extended hollow housing and a pressure stub held partly within the compression spring; wherein the pressure stub is structured with an extended portion having a cross dimension smaller than the interior size of the compression spring and a head having a larger size than the interior size of the compression spring, wherein the extended portion extends within the internal hollow of the compression spring and is also hollow and provided with an internal screw thread in the hollow section for threadable engagement with an external screw thread at the end of a biasing cable of a ski binding, the biasing cable being threadable through the centre of the compression spring to the pressure stub; wherein rotation of the pressure stub would thus lead to a change in the amount of the biasing cable held within the hollow section, when present, and thus change the amount of compressive force acting on the compression spring.

2. The spring cartridge of claim 1, further comprising:

a rotatable adjustment knob held in one of the open ends of the extended hollow housing, wherein the rotatable adjustment knob has a first mating structure held within the extended hollow housing which matches with a second mating structure on the head of the pressure stub such that when in mated engagement, rotation of the rotatable adjustment knob leads to rotation of the pressure stub.

3. The spring cartridge of claim 1, wherein the compression spring and pressure stub are held within the extended hollow housing by means of a reduced cross-section at both ends ensuring that the openings defined at the ends are smaller than the outer dimension of the compression spring and head of the pressure stub.

4. The spring cartridge of claim 2, wherein the rotatable adjustment knob has either indents or protrusions on the portion located outside of the extended hollow housing which interact with appropriate protrusions or indents, respectfully, on either the extended hollow housing or the ski binding when the spring cartridge is mounted therewith, such that rotation of the adjustment knob proceeds in a click-wise or rotationally stepped manner.

5. The spring cartridge of claim 2, wherein the portion of the rotatable adjustment knob positioned outside of the extended hollow housing is structured with a plurality of teeth around the outer rim and/or with an appropriate structure for receiving a screwdriver.

6. The spring cartridge of claim 2, wherein the rotatable adjustment knob has a reduced cross-sectional part which is slightly smaller than the size of the hole at the end of the extended hollow housing, and two larger cross-sectional sections either side of this, one positioned within the extended hollow housing and the other positioned outside of the extended hollow housing, with cross-sectional sizes larger than the size of the hole.

7. The spring cartridge of claim 2, wherein the extended hollow housing is cylindrical.

8. The spring cartridge of claim 2, wherein the first mating structure on the rotatable adjustment knob is provided by a slot and the second mating structure is provided by shaping the entire head of the pressure stub such that it will engagingly fit within the slot.

9. A ski binding for a ski wherein the ski binding comprises:

a rotatable front binding part for attachment of a ski boot, the rotatable front binding part being rotatably connected to a main part of the ski binding; and a biasing cable connected between the rotatable front binding part and the main part which is held under tension by means of the spring cartridge according to claim 2.

10. The ski binding of claim 9, wherein the spring cartridge is held in the main part of the ski binding and the biasing cable is attached between the rotatable front binding part and the pressure stub, such that rotation of the rotatable front binding part will draw the biasing cable through the spring cartridge and by means of the pressure stub will compress the compression spring.

11. The ski binding of claim 9, wherein the spring cartridge is held in the rotatable front binding part of the ski binding and the biasing cable is attached between the main part and the pressure stub, such that rotation of the rotatable front binding part will draw the biasing cable through the spring cartridge and by means of the pressure stub will compress the compression spring.

12. The ski binding of claim 9, wherein two spring cartridges are provided on the rotatable front binding part generally parallel and facing in the same direction, and the biasing cable passes from the pressure stub of the first spring cartridge to the pressure stub of the second spring cartridge via a looping post provided on the main part of the ski binding, wherein with rotation of the rotatable front binding part the looping post stops translational movement of the biasing cable with respect to the main part of the ski binding and thus leads to the biasing cable being drawn through each of the two spring cartridges against the biasing force from each compression spring.

13. The ski binding of claim 12, wherein the looping post is held in a releasable manner in the main part of the ski binding, and wherein the looping post can be manually released, and slideably moved toward the spring cartridges so as to remove the tension in the biasing cable and from the compression springs.

* * * * *